US008690021B2

(12) United States Patent
Asraf

(10) Patent No.: US 8,690,021 B2
(45) Date of Patent: Apr. 8, 2014

(54) CONTAINER LINER AND A METHOD OF DISCHARGING A CONTAINER LINER

(75) Inventor: Ofer Asraf, Helsingborg (SE)

(73) Assignee: Caretex APS

( * ) Notice: Subject to any disclaimer, the term of this patent is extended or adjusted under 35 U.S.C. 154(b) by 359 days.

(21) Appl. No.: 12/989,431

(22) PCT Filed: Apr. 23, 2009

(86) PCT No.: PCT/EP2009/054881

§ 371 (c)(1),
(2), (4) Date: Oct. 25, 2010

(87) PCT Pub. No.: WO2009/130271

PCT Pub. Date: Oct. 29, 2009

(65) Prior Publication Data

US 2011/0198368 A1 Aug. 18, 2011

(30) Foreign Application Priority Data

Apr. 25, 2008 (EP) ..... 08103727

(51) Int. Cl.

| | |
|---|---|
| ***B65G 69/06*** | (2006.01) |
| ***B67D 7/06*** | (2010.01) |
| ***B67D 7/84*** | (2010.01) |
| ***B65D 88/00*** | (2006.01) |
| ***B65D 25/14*** | (2006.01) |
| ***B65D 35/14*** | (2006.01) |
| ***B65D 90/00*** | (2006.01) |
| ***B65G 53/38*** | (2006.01) |

(52) U.S. Cl.
USPC ..... 222/195; 222/166; 220/1.6; 220/495.06; 406/137

(58) Field of Classification Search
USPC ..... 222/195, 386.5, 164, 166, 105, 630, 222/637; 220/1.5, 1.6, 495.01, 495.06; 406/136–138; 414/467
See application file for complete search history.

(56) References Cited

U.S. PATENT DOCUMENTS

| | | | | |
|---|---|---|---|---|
| 3,201,000 | A * | 8/1965 | Hermanns | 406/91 |
| 5,181,625 | A * | 1/1993 | Podd et al. | 220/1.5 |
| 5,489,037 | A * | 2/1996 | Stopper | 220/1.5 |
| 5,547,331 | A * | 8/1996 | Podd et al. | 414/808 |
| 7,597,525 | B2 * | 10/2009 | McMahon et al. | 414/539 |

(Continued)

FOREIGN PATENT DOCUMENTS

| | | |
|---|---|---|
| AU | 623 305 B1 | 5/1992 |
| EP | 1101712 A1 | 5/2001 |

(Continued)

OTHER PUBLICATIONS

Takanashi, Yoji, English Translation of JP 02-114696 (U), Sep. 13, 1990, Translated Sep. 19, 2013.*

*Primary Examiner* — Paul R Durand
*Assistant Examiner* — Matthew Lembo
(74) *Attorney, Agent, or Firm* — Gifford, Krass, Sprinkle, Anderson & Citkowski, P.C.

(57) ABSTRACT

The present invention concerns a container liner with an aerate system which reduces the specific bulk density of the powder material inside the liner and thereby improves the flowability of the product. This significantly reduces the unloading time and increases the safety in relation to the discharge process due to a lower response angle and thereby that the required tilting angle of the cargo container is reduced.

16 Claims, 4 Drawing Sheets

(56) References Cited

U.S. PATENT DOCUMENTS

| | | | | |
|---|---|---|---|---|
| 2006/0054639 | A1 | 3/2006 | Bonerb | |
| 2006/0186117 | A1 * | 8/2006 | Podd | 220/1.6 |
| 2007/0023438 | A1 | 2/2007 | Kenneth, Jr. | |
| 2007/0102428 | A1 | 5/2007 | Eamcharoenying | |

FOREIGN PATENT DOCUMENTS

| | | | |
|---|---|---|---|
| GB | 1580806 | A | 12/1980 |
| JP | 58167628 | | 10/1983 |
| JP | 1253425 | | 2/1985 |
| JP | 02114696 | U * | 9/1990 |
| JP | 2003225043 | | 8/2003 |
| JP | 2005239266 | | 9/2005 |
| WO | WO93/04954 | | 3/1993 |
| WO | WO94/06648 | | 3/1994 |
| WO | WO20051014449 | | 2/2005 |

* cited by examiner

CONTAINER LINER AND A METHOD OF DISCHARGING A CONTAINER LINER

CROSS-REFERENCE TO RELATED APPLICATIONS

This application is the U.S. national phase of PCT/EP2009/054881 filed Apr. 23, 2009, which claims priority of European Patent Application No. 08103727.7 filed Apr. 25, 2008.

FIELD OF INVENTION

The present invention relates to a container liner for use in a box like cargo container for transportation of powder or other flowable material, said liner comprising top and bottom wall portions, two side wall, portions and first and second end wall portions corresponding to the wall portions of the container, a discharge opening at the lower portion of said first end wall through which the contents of the liner are discharged, aeration means at the lower portion of the container liner for agitating the content of the liner during discharge. The invention also relates to a method of discharging such container liner.

Box-like cargo containers are used for transportation of a variety of products. For some products, it is advantageous to fit the container with a flexible liner of e.g. polyethylene or the like. Powder or other flowable materials can be loaded directly from a storage space, such as a silo or the like and into the liner of the container saving a packaging operation by the manufacturer while also making more efficient use of the container space, as packaging materials, such as bags, pallets, etc. do not have to be transported with the products.

The product in the container liner can subsequently be unloaded and transferred directly into a new storage space at the recipient. All in all, the whole handling process is considerably easier and cost effective. The product can be discharged from the container liner by tilting the container whereby the powder or similarly flowable material flows by means of gravity towards and out of a discharge opening at the lower end of the container liner.

However, many of such powder or similarly flowable dry materials have a relatively high angle of response which can cause difficulties in discharging the material from the shipping container as the material will not flow freely when the container is tilted.

BACKGROUND OF INVENTION

From the international patent application No. WO 94/06648 it is known to aerate and agitate the cargo in the container to ensure the cargo flows smoothly out of the tilted container. Accordingly, air permeable pads are installed in the container liner. The pads comprise a body and a hose and to help unload the cargo from a container, is conducted into the bulls cargo via one or more air permeable pads to aerate and agitate the cargo therein.

In or WO 93/04954 is disclosed a floor mat and a container liner for a shipping container, said floor mat having a plurality of micro-perforations, and an array of channels whereto a flow of gas may be provided by a gas manifold. The floor mat may be used for shipping containers to facilitate discharge of materials in fine particulate form.

in US 2007/0023438 A1 is described a tank liner and a tank with a plurality of evacuation members for evacuating the air between the tank liner and the tank, said tank liner and tank may be used in storage or transportation of fluids and liquids. There is described evacuation of air but no disclosure of apertures for supplying pressurized air in order to discharge powder or other flowable material.

Other examples of air permeable pads with micro-perforated upper surfaces are known from WO 2005/014449.

SUMMARY OF INVENTION

With regard to the background art, it may be an object of the invention to provide an improved liner and a method of discharging said liner facilitating a discharge at a lower response angle in order to reduce the required discharge tilt angle.

This object is achieved by a container liner of the initially mentioned kind, wherein the aeration means comprises at least one perforated semi-rigid hose having a free end outside the container liner and is connectable to a pressurised gas source.

Moreover, there is provided a method of discharging a flexible container liner in a box-like cargo container for transportation of powder or other flowable material, said liner comprising top and bottom wall portions, two side wall portions and first and second end wall portions corresponding to the wall portions of the container, a discharge opening at the lower portion of said first end wall through which the contents of the liner are discharged, aeration means at the lower portion of the container liner for agitating the content of the liner during discharge, said method comprising the steps of tilting the container, and aerating the powder material content through aeration means comprising at least one perforated semi-rigid hose having a free end outside the container liner and is connectable to a pressurised gas source, thereby causing the material within the liner to flow towards and through a discharge opening at the lower portion of said first end wall through which the content of the liner is discharged.

According to the invention there is provided a container liner with an aerate system which reduces the specific bulk density of the granular product inside the liner and thereby agitating the powder. Hereby the powder which is accumulated and is packed in a compact structure is "disturbed" so that the flow ability of the powder may be provided by the gravity. This significantly reduces the unloading time and increases the safety in relation to the discharge process due to a lower response angle and thereby that the required tilting angle of the cargo container is reduced. Moreover, by the invention the function is not necessarily oxidising the powder (if air or oxygen is used as gas source). The compact powder is agitated and thereby loosened by a blast-like impact so that the powder is subjected to a knock-down effect; whereafter gravity can take over for the discharge process.

In one embodiment, a plurality of perforated hoses is provided, each provided at a specific area in the bottom wall of the liner. In another embodiment, one perforated hose is provided having both its ends outside the container for gas supply during discharge. By appropriately arranging one or more perforated hoses, either the entire bottom wall or specific areas on the bottom wall of the liner may be prepared with this aerate system according to the invention.

In a particular embodiment, the at least one perforated hose is provided in a discharge portion of the liner forming a funnel-like discharge channel between a storage volume of the liner and the discharge opening. By specifically subjecting the discharge region of the liner to this jet flow aeration system according to the invention, the discharge will be facilitated through out the entire discharge, i.e. also when only a minor portion of the powder content remains in the liner.

Preferably, the at least one perforated hose is made of an elastomeric material, preferably polyvinylchloride (PVC), polyethylene, polypropylene or the like, and preferably having a flexibility similar to the material of the liner or even being made in the same material as the liner.

Preferably, the at least one perforated hose comprises perforations with a predetermined distance along its length, preferably in a plurality of longitudinal rows. Hereby, the hoses may be designed for introducing gas, such as pressurised air, into the bulk with a substantially even impact on the powder material.

Advantageously, hose suspension means are provided on the liner. Moreover, the hose suspension means comprises disks attached to the liner wall said disks comprising two apertures through which a hose may be treaded. Hereby the hose may be pre-mounted in the liner.

Preferably, the disks are peripherally sealed to the liner wall, preferably by welding the disks to the liner. Hereby, a risk of creating a leak in the liner and potentially contaminating the cargo therein is avoided.

Preferably, the liner and the hoses are transparent.

Above and below, the invention is described with reference to powder or the like. However, it is realised by the invention that any powdered dry material, including granular or pellet materials, may also be understood by the material specification, just as a mix of two or more materials are regarded as being incorporated in the term powder or similar flowable material.

DESCRIPTION OF DRAWINGS

In the following, the invention is described in more detail with reference to the accompanying drawings, in which.

DETAILED DESCRIPTION OF THE INVENTION

Figure 1:
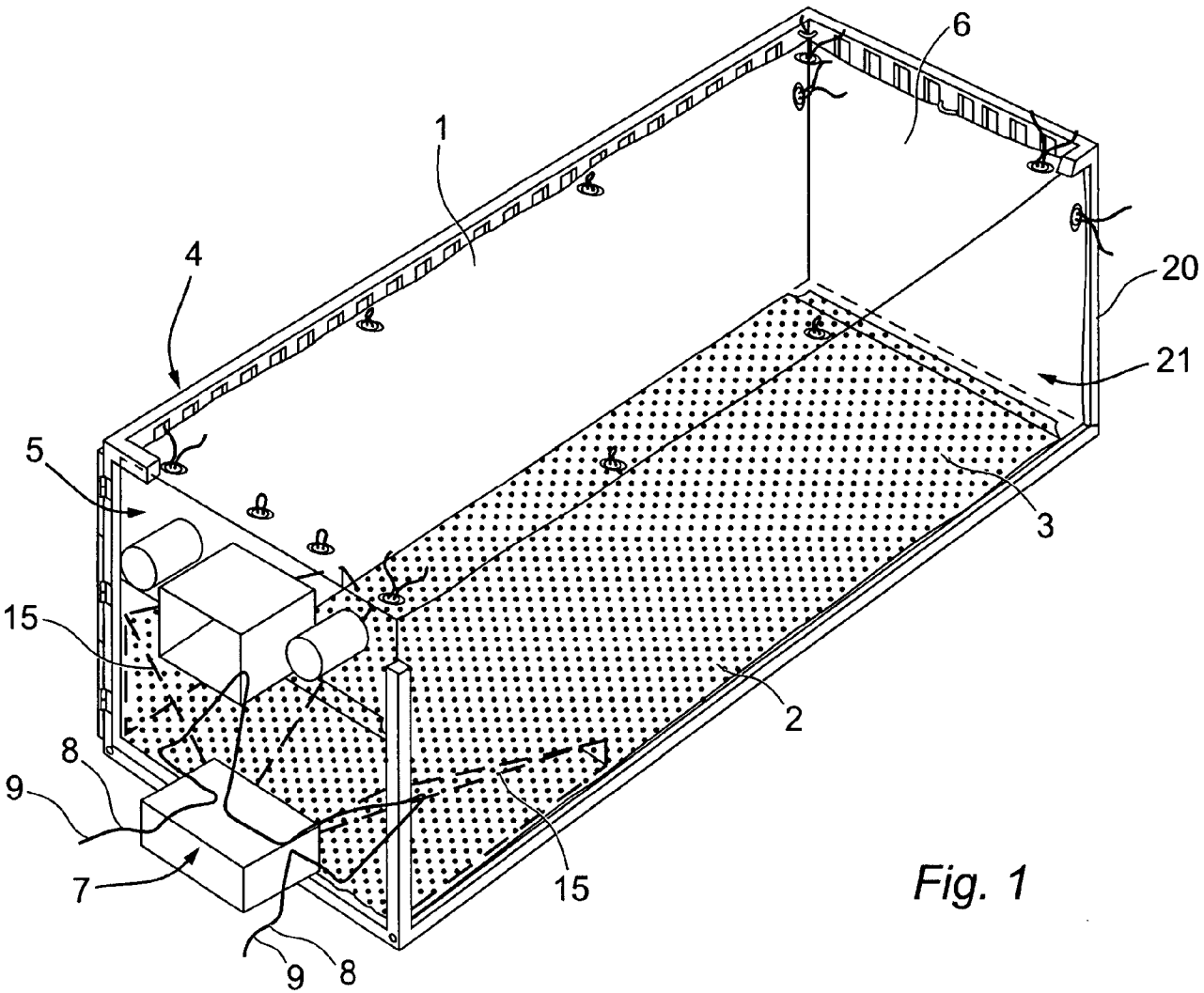
FIG. 1 is a perspective view of a container liner according to a first embodiment of the invention.
Figure 2:
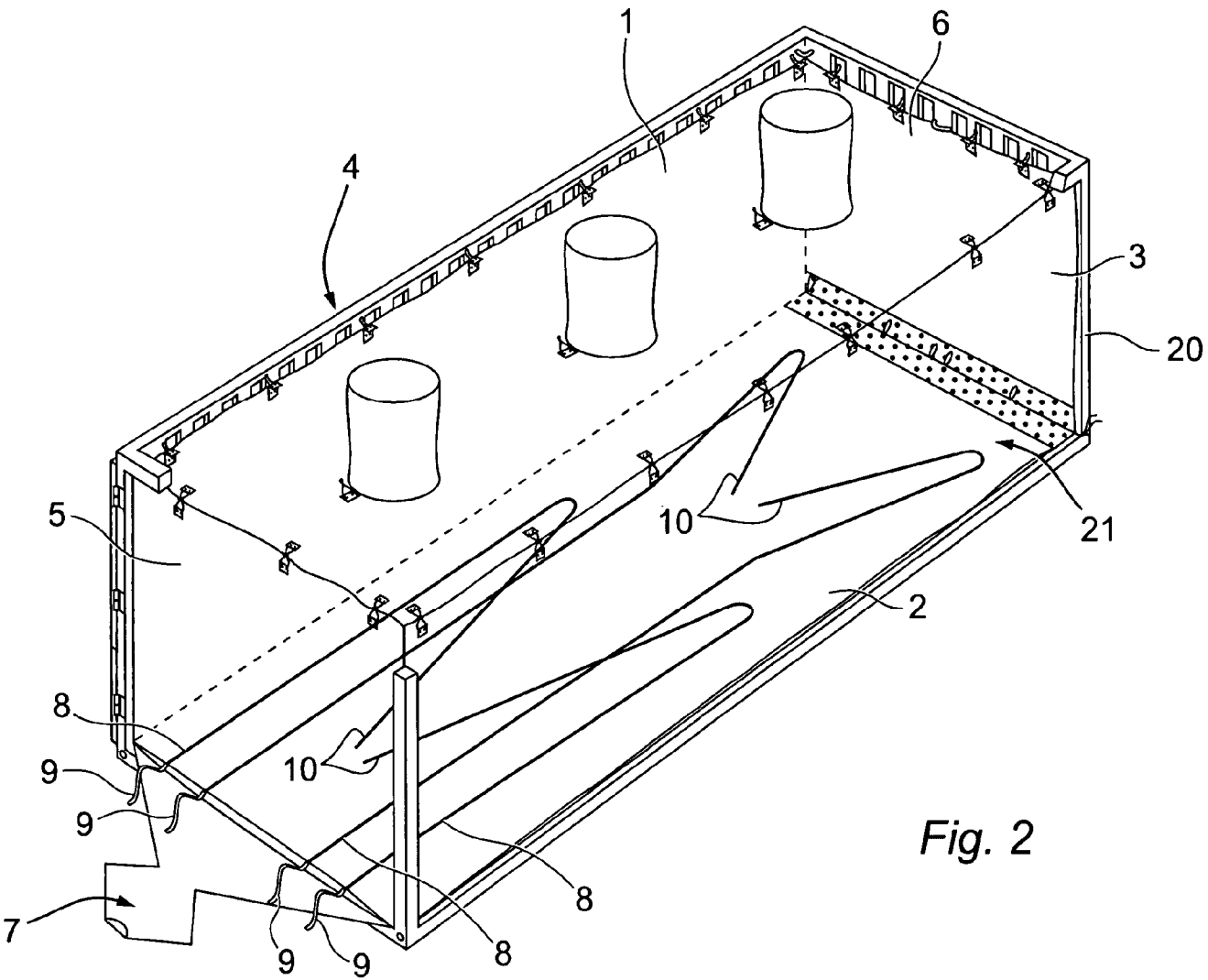
FIG. 2 is a perspective view of a container liner according to a second embodiment of the invention.
Figure 3:
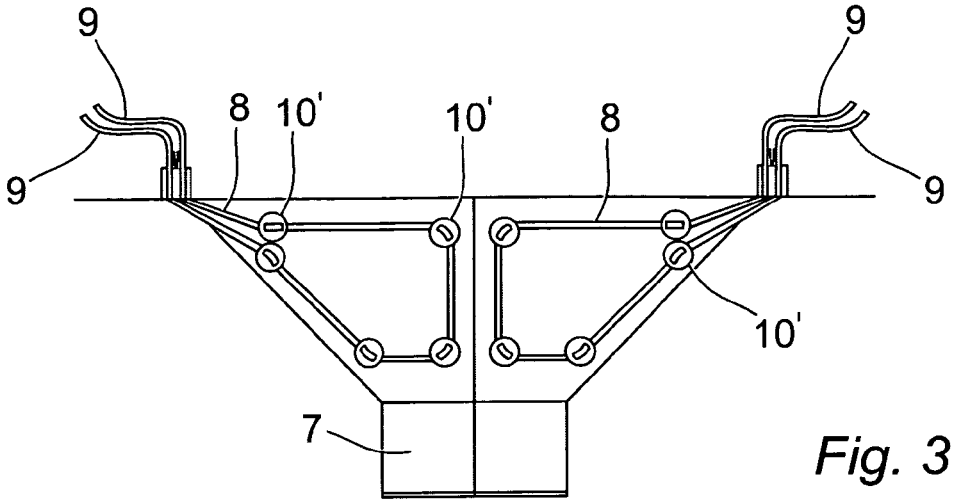
FIG. 3 is a schematic top view of a third embodiment of the invention.

In FIG. 1 there is shown a container liner 21 mounted in a container 20. The container liner has a box-like configuration when mounted which corresponds to the inside of the shipping container. The liner comprises a top wall 1 and a bottom wall portion 2, first and second side wall portions, 3 and 4, respectively, and a first end wall portion 5 and a second end wall portion 6. At the first end, a discharge opening 7 is provided, which may be a rectangular chute, as shown in FIG. 1 or a funnel-like shape as shown in FIGS. 2 and 3. The liner 21 may also be provided with other features such as inlet openings, inflatable air bag corners, ventilation means or the like, such as indicated in the FIGS. 1 and 2.

In the embodiment of the invention shown in FIG. 1, a perforated hose 8 is provided in area of the bottom wall portion 2 of the discharge opening 7. The hose 8 in this embodiment is provided as a single perforated hose 8 extending from one side of the discharge opening 7 to the other through the bottom area of the liner and the inclined surfaces due to the airbags 15 inflated during a discharge operation. The hose 8 according to this first embodiment has both its free ends 9 outside the liner, so that said free ends 9 are accessible for connection to a pressurised gas source (not shown).

In FIG. 2, a second embodiment of a container liner according to the invention is shown. The liner 21 is shown in its mounted position inside a container 20 (shown in a schematic cut-away view). In this embodiment, the liner 21 is provided with a plurality of perforated hoses 8. In the embodiment shown, there is provided two perforated hoses 8 on each side of the liner provided on the bottom wall portion 2 of the liner. The free ends 9 of the hoses 8 are outside the liner and thereby accessible from outside the container so that pressurised air or other types of gas may be injected into the perforated hoses 8. In the embodiment of FIG. 2, the hoses 8 have internal second free ends 10 inside the liner 21, whereby the internal free end opening on the hoses 8 provided a terminating aperture perforation for injecting gas into the powder material inside the liner during discharge.

Figure 6:
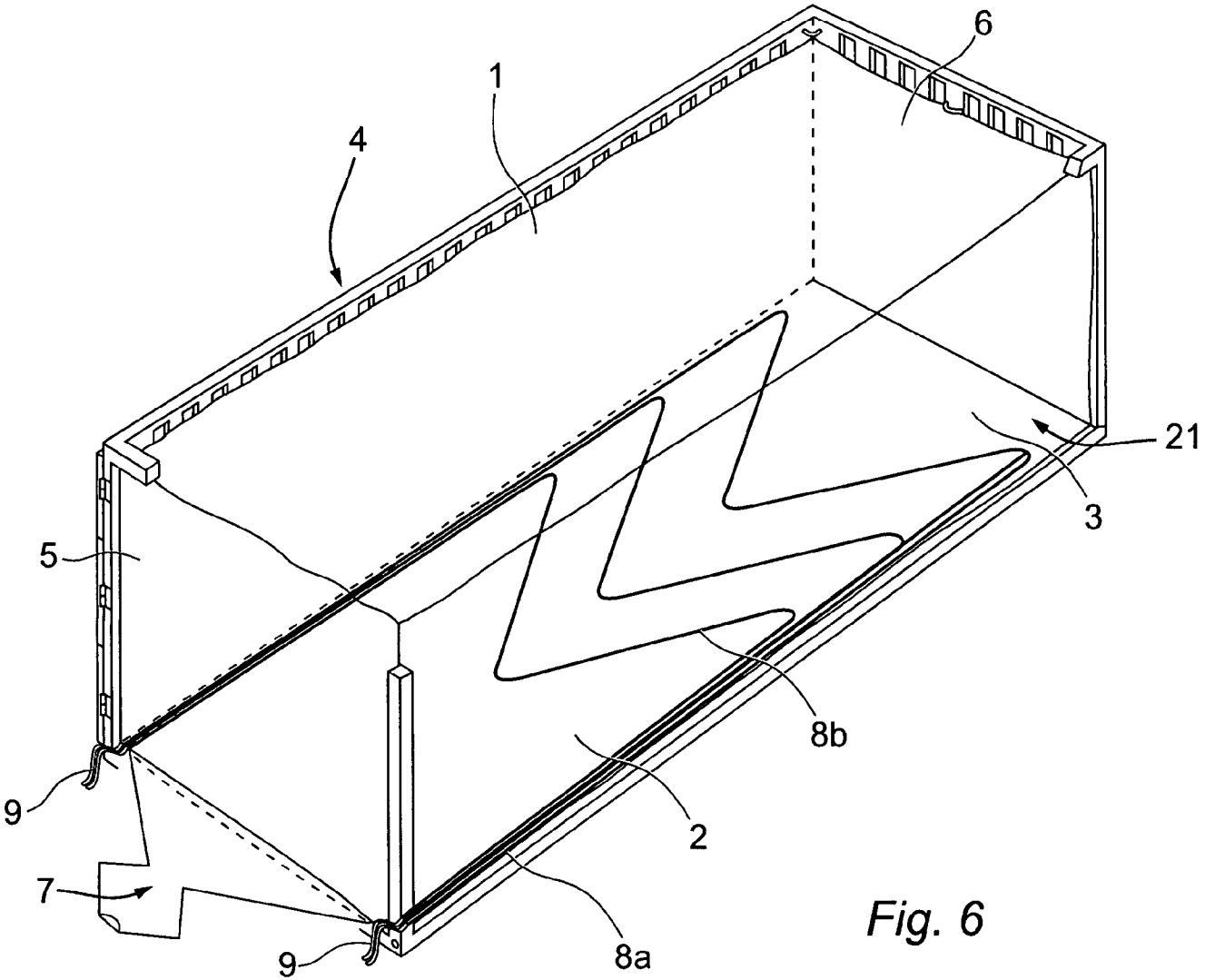
FIG. 6 is a perspective view of a container liner according to a fourth embodiment of the invention.

In FIG. 6, a third embodiment of a container liner according to the invention is shown. In this embodiment, the liner 21 is provided with a plurality of perforated hoses 8. In the embodiment shown, there is provided three perforated hoses with first 8*a* and second 8*b* hose portions provided in part on the bottom wall portion 2 of the liner, entering through the first side wall portion 3, and leaving through the second side wall portion 4, such that the first hose portions 8*a* of the hoses pass along the outside of the liner while the second hose portions 8*b* are provided inside the liner, such as on the bottom wall portion of the liner or beneath the bottom wall portion. In one embodiment, at least one perforated hose comprises at least one first hose portion adapted for engagement with at least one second hose portion, wherein the at least one first hose portion is provided along the outside of the liner. Preferably, the first hose portions 8*a* are not perforated. The free ends 9 of the hoses are outside the liner and thereby accessible from outside the container so that pressurised air or other types of gas may be injected into the perforated hoses. By having first hose portions 8*a* passing outside the liner, such as along the side wall portions, or passing along a corner inside the liner, the risk of ruptures and the like is reduced compared to embodiments where larger portions of the hoses pass within liner wall portions or are provided on the bottom wall portion of the liner. In addition, the space not used by the liner outside of the liner may be unexploited and therefore available for hose portions in the bottom corner along the side of the liner. Further, the hose portions passing along the outside of the liner or along a corner inside the liner may be subject to lesser pressure and weight from the cargo compared to hose portions passing across wall portions of the liner or provided on the bottom wall portion of the liner.

Figure 5:
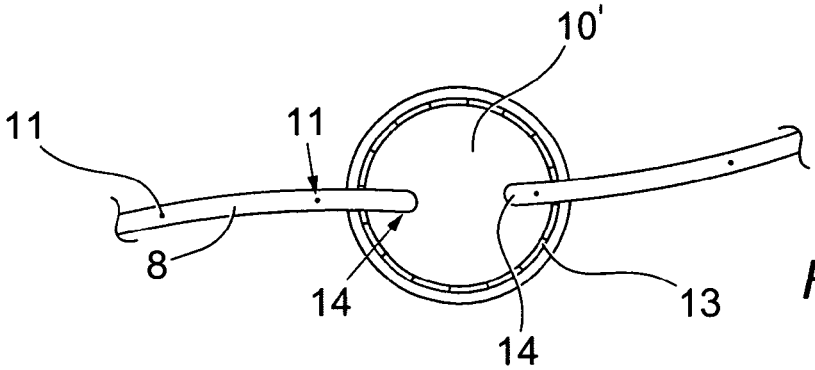
FIG. 5 is a detailed view of suspension of a hose according to are embodiment of the invention.

As shown in FIG. 3, the hoses 8 may also be provided in the discharge region in a funnel-like discharge chute leading the powder material inside the liner to a discharge opening 7. In this third embodiment, two hoses 8 are provided for agitating the powder material in each side on the discharge chute. The hoses 8 have their free ends 9 outside the container for connection to a gas supply. The hoses 8 are attached to the liner by a plurality of suspension means in the form of disks 10'. This suspension form may also be used in any of the previously described embodiments. A preferred embodiment of the disks 10' is shown in detail in FIG. 5.

The disks are provided with two apertures 14 through which the flexible perforated hose 8 is threaded. The disk is welded to the liner by a circumferential welding seam 13 which also acts as a seal so that it does not matter if air is ejected out of a perforation in the portion of the hose 8 between the two apertures 14, i.e. the space between the disk 10' and the liner wall (not shown in FIG. 5).

Figure 4:
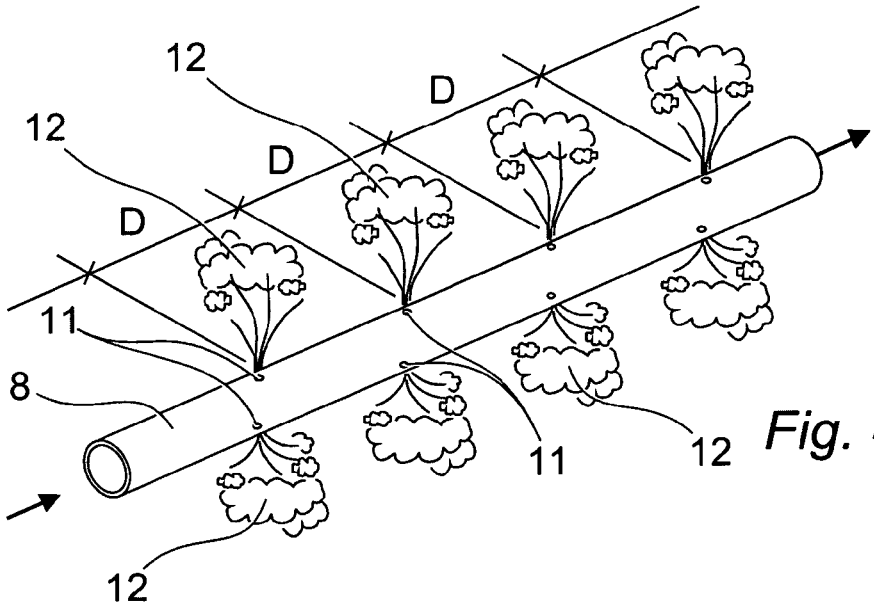
FIG. 4 is a schematic explanatory illustration of a aerate hose according to an embodiment of the invention.

In FIG. 4, a schematic view of a perforated hose 8 is shown. The perforations 11 are provided in one or more rows on the hose 8, preferably as shown in two longitudinal rows on each side of the hose 8. The apertures 11 are provided with a certain distance D. However it is realised that the distance between and position of the apertures may be chosen randomly or according to circumstances, i.e. with respect to ejecting gas into the powder in a particular pattern or with respect to easy manufacturing of the hoses 8. The air or other type of gas is ejected into the hose 8 and escapes through the apertures 11 and into the inside volume of the liner and creates a small spray 12 which impacts the powder around the hose 8, such as a distance of e.g. 20 cm from the hose 8.

The invention claimed is:

1. A container liner for use in a box-like cargo container for transportation of powder or other flowable material, the cargo container having wall portions, said liner comprising:

top and bottom wall portions, two side wall portions and first and second end wall portions corresponding to the wall portions of the container;

a discharge opening at a lower portion of said first end wall portion through which contents of the liner are discharged;

aeration means at a lower portion of the container liner for agitating the contents of the liner during discharge;

wherein the aeration means comprises at least one perforated semi-rigid hose having a free end outside the container liner and a portion disposed in an inside volume of the container liner for direct contact with the contents, said at least one perforated hose being an element separate from the wall portions of the liner, said at least one perforated hose being connectable to a pressurized gas source; and wherein said at least one semi-rigid hose is disposed such that gas escapes through perforations in the portion disposed in the inside volume of the container liner, the gas escaping through the perforations creating small sprays which impact the contents around the hose.

2. A liner according to claim 1, wherein said at least one hose comprises a plurality of perforated hoses, each provided at a specific area of the bottom wall portion of the liner.

3. A liner according to claim 1, wherein said at least one perforated hose is provided in a discharge portion of the liner forming a funnel-like discharge channel between a storage volume of the liner and the discharge opening.

4. A liner according to claim 1, wherein said at least one perforated hose is provided having both its ends outside the container for gas supply during discharge.

5. A liner according to claim 1, wherein said at least one perforated hose is made of an elastomeric material.

6. A liner according to claim 1, wherein said at least one perforated hose comprises perforations spaced apart by a predetermined distance along its length, disposed in a plurality of longitudinal rows.

7. A liner according to claim 1, further comprising a hose suspension provided on the liner.

8. A liner according to claim 7, wherein the hose suspension comprises disks attached to the liner wall portions, said disks comprising two apertures through which a hose may be threaded.

9. A liner according to claim 8, wherein the disks are peripherally sealed to the liner wall portions.

10. A liner according to claim 1, wherein the liner wall portions and said at least one hose are transparent.

11. A liner according to claim 1, wherein the gas source is a supply of pressurised air.

12. A liner according to claim 1, wherein the gas source is a supply of pressurised nitrogen and/or other gas types.

13. A liner according to claim 1, wherein said at least one perforated hose comprises at least one first hose portion adapted for engagement with at least one second hose portion, wherein the at least one first hose portion is provided along the outside of the liner.

14. A liner according to claim 13, wherein the at least one first hose portion is not perforated.

15. A liner according to claim 1, further comprising:

a plurality of disks for supporting the portion of the at least one hose in the inside volume of the container liner, each disk having an aperture therethrough, the at least one hose extending through the apertures of the plurality of disks.

16. A method of discharging a flexible container liner in a box-like cargo container for transportation of powder or other flowable material, said liner comprising top and bottom wall portions, two side wall portions and first and second end wall portions corresponding to wall portions of the container, a discharge opening at a lower portion of said first end wall portion through which contents of the liner are discharged, and aeration means at the lower portion of the container liner for agitating the contents of the liner during discharge, said method comprising the steps of:

tilting the container; and aerating the contents through aeration means comprising at least one perforated semi-rigid hose having a free end outside the container liner and connectable to a pressurized gas source, the at least one semi-rigid hose having at least a portion disposed in an inside volume of the container liner for direct contact with the contents and being disposed such that gas escapes through perforations in the portion disposed in the inside volume of the container liner, the gas escaping through the perforations creating small sprays which impact the contents around the hose, said at least one perforated hose being an element separate from the wall portions of the liner;

thereby causing the material within the liner to flow towards and through a discharge opening at the lower portion of said first end wall portion through which the contents of the liner is discharged.

* * * * *